US008459534B2

(12) United States Patent
Bradford

(10) Patent No.: US 8,459,534 B2
(45) Date of Patent: Jun. 11, 2013

(54) CARTON WITH REINFORCED TOP PANEL

(75) Inventor: Paul Bradford, Bristol (GB)

(73) Assignee: Graphic Packaging International, Inc., Marietta, GA (US)

( * ) Notice: Subject to any disclaimer, the term of this patent is extended or adjusted under 35 U.S.C. 154(b) by 475 days.

(21) Appl. No.: 12/725,738

(22) Filed: Mar. 17, 2010

(65) Prior Publication Data

US 2010/0237138 A1 Sep. 23, 2010

Related U.S. Application Data

(60) Provisional application No. 61/210,292, filed on Mar. 17, 2009.

(51) Int. Cl.
*B65D 5/468* (2006.01)

(52) U.S. Cl.
USPC ..... 229/117.13; 229/199; 229/930; 206/427

(58) Field of Classification Search
USPC ..... 229/103.2, 117.13, 117.14, 132, 229/136, 199, 930; 206/427
See application file for complete search history.

(56) References Cited

U.S. PATENT DOCUMENTS

| | | | |
|---|---|---|---|
| 1,925,102 | A | 9/1933 | Levkoff |
| 2,005,924 | A | 6/1935 | Wilson |
| 2,067,749 | A | 1/1937 | Zimmerman et al. |
| 2,115,673 | A | 4/1938 | Stompe |
| 2,196,502 | A | 4/1940 | Kells |
| 2,299,027 | A | 10/1942 | Novak |
| 2,386,905 | A | 10/1945 | Meitzen |
| 2,648,484 | A | 8/1953 | Belsinger |
| 2,669,351 | A | 2/1954 | Carson et al. |
| 2,754,047 | A | 7/1956 | Schmidt et al. |
| 3,078,032 | A | 2/1963 | Robinson et al. |
| 3,128,010 | A | 4/1964 | Forrer |
| 3,133,634 | A | 5/1964 | Bozdar |
| 3,173,596 | A | 3/1965 | Aust et al. |
| 3,178,242 | A | 4/1965 | Ellis et al. |
| 3,228,582 | A | 1/1966 | Osberg |
| 3,263,861 | A | 8/1966 | Carr |

(Continued)

FOREIGN PATENT DOCUMENTS

| | | |
|---|---|---|
| CA | 873185 A1 | 6/1971 |
| EP | 0 066029 | 12/1982 |

(Continued)

OTHER PUBLICATIONS

International Search Report for PCT/US2010/027597, mailed Oct. 27, 2010.

(Continued)

*Primary Examiner* — Gary Elkins
(74) *Attorney, Agent, or Firm* — Womble Carlyle Sandridge & Rice, LLP

(57) ABSTRACT

A carton for containing a plurality of containers. The carton comprises a plurality of panels extending at least partially around an interior of the carton. The plurality of panels comprises a bottom panel, a first side panel foldably connected to the bottom panel, a top panel foldably connected to the first side panel, a second side panel foldably connected to the bottom panel, and a reinforcement panel foldably connected to the second side panel. The reinforcement panel is in face-to-face contact with the top panel.

27 Claims, 6 Drawing Sheets

U.S. PATENT DOCUMENTS 3,265,283 A 8/1966 Farquhar
3,300,115 A 1/1967 Schauer
3,332,594 A 7/1967 De Capua
3,346,167 A 10/1967 Schmidt
3,356,279 A 12/1967 Root
3,517,858 A 6/1970 Farquhar
3,533,549 A 10/1970 Gilchrist
3,540,581 A 11/1970 Koolnis
3,825,170 A 7/1974 Aust et al.
3,904,036 A 9/1975 Forrer
4,155,449 A 5/1979 Bryne
4,214,660 A 7/1980 Hunt, Jr.
4,222,485 A 9/1980 Focke
4,256,226 A 3/1981 Stone
4,318,474 A 3/1982 Hasegawa
4,364,509 A 12/1982 Holley, Jr. et al.
4,375,258 A 3/1983 Crayne et al.
4,376,509 A 3/1983 Schaffer
4,378,877 A 4/1983 Botterman et al.
4,396,143 A 8/1983 Killy
4,417,655 A 11/1983 Forbes, Jr.
4,417,661 A 11/1983 Roccaforte
4,538,759 A 9/1985 Dutcher
4,577,762 A 3/1986 Kuchenbecker
4,588,084 A 5/1986 Holley, Jr.
4,605,128 A 8/1986 Rieke
4,621,766 A 11/1986 McClure
4,658,984 A 4/1987 Brunner
4,757,938 A 7/1988 Collins
4,817,866 A 4/1989 Wonnacott
4,830,267 A 5/1989 Wilson
4,890,440 A 1/1990 Romagnoli
4,949,845 A 8/1990 Dixon
4,967,901 A 11/1990 Wood
4,974,771 A 12/1990 Lavery
5,072,876 A 12/1991 Wilson
5,101,642 A 4/1992 Alexandrov
5,119,985 A 6/1992 Dawson et al.
5,137,211 A 8/1992 Summer et al.
5,219,229 A 6/1993 Sengewald
5,249,681 A 10/1993 Miller
5,297,725 A 3/1994 Sutherland
5,320,277 A * 6/1994 Stout et al. ..... 229/117.13
5,333,734 A 8/1994 Stout et al.
5,350,109 A 9/1994 Brown et al.
5,425,474 A 6/1995 Dalea et al.
5,482,185 A 1/1996 McNaughton
5,482,203 A 1/1996 Stout
5,505,372 A 4/1996 Edson et al.
5,577,612 A 11/1996 Chesson et al.
5,588,585 A 12/1996 McClure
5,597,114 A 1/1997 Kramedjian et al.
5,622,309 A 4/1997 Matsuda et al.
5,664,683 A 9/1997 Brody
5,690,213 A 11/1997 Matsumura
5,690,230 A 11/1997 Griffith
5,794,778 A 8/1998 Harris
5,826,783 A 10/1998 Stout
5,873,516 A 2/1999 Boggs
5,875,961 A 3/1999 Stone et al.
5,881,884 A 3/1999 Podosek
5,921,398 A 7/1999 Carroll
5,924,559 A 7/1999 Carrel et al.
5,927,498 A 7/1999 Saam
6,050,402 A 4/2000 Walter
6,170,741 B1 1/2001 Skolik et al.
6,176,419 B1 1/2001 Holley, Jr.
6,250,542 B1 6/2001 Negelen
6,283,293 B1 9/2001 Lingamfelter
6,302,320 B1 * 10/2001 Stout ..... 229/117.13
6,409,077 B1 6/2002 Telesca et al.
D459,927 S 7/2002 Flowers et al.
6,471,120 B1 10/2002 Vogel
6,478,219 B1 11/2002 Holley, Jr.
6,484,903 B2 11/2002 Spivey et al.
6,550,615 B2 4/2003 Lingamfelter
6,557,699 B1 5/2003 Focke et al.
6,578,736 B2 6/2003 Spivey
6,604,677 B1 8/2003 Sutherland et al.
6,631,803 B2 10/2003 Rhodes et al.
6,669,083 B2 12/2003 Bates
6,715,639 B2 4/2004 Spivey
6,752,262 B1 6/2004 Boriani et al.
6,789,673 B2 9/2004 Lingamfelter
6,848,573 B2 2/2005 Gould et al.
6,866,186 B2 3/2005 Fogle et al.
6,902,104 B2 6/2005 Holley, Jr. et al.
6,918,487 B2 7/2005 Harrelson
6,926,193 B2 8/2005 Smalley
6,929,172 B2 8/2005 Bates et al.
6,932,265 B2 8/2005 Sax et al.
6,968,992 B2 11/2005 Schuster
6,974,072 B2 12/2005 Harrelson
6,991,107 B2 1/2006 Harrelson
6,997,316 B2 2/2006 Sutherland
7,000,803 B2 2/2006 Miller
7,073,665 B2 7/2006 Auclair et al.
7,104,435 B2 9/2006 Holley, Jr.
7,134,593 B2 11/2006 Harrelson
7,159,759 B2 1/2007 Sutherland
7,225,930 B2 6/2007 Ford et al.
7,422,104 B2 * 9/2008 Perkinson ..... 206/427
7,478,743 B2 1/2009 Holley, Jr.
7,604,157 B2 10/2009 Zammit et al.
7,699,215 B2 4/2010 Spivey, Sr.
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2003/0006158 A1 1/2003 Skolik et al.
2003/0136820 A1 * 7/2003 Negelen ..... 229/117.13
2003/0141313 A1 7/2003 Bates
2003/0150759 A1 8/2003 White, Jr.
2003/0192907 A1 10/2003 Bates
2004/0040334 A1 3/2004 Rusnock
2004/0060972 A1 4/2004 Harrelson
2004/0089575 A1 5/2004 Lingamfelter
2004/0089671 A1 5/2004 Miller
2004/0099558 A1 5/2004 Oliff et al.
2004/0155098 A1 8/2004 Harrelson
2004/0188277 A1 9/2004 Auclair
2004/0188300 A1 9/2004 Sutherland
2004/0188508 A1 9/2004 Holley, Jr. et al.
2005/0023170 A1 2/2005 Lingamfelter
2005/0092820 A1 5/2005 Chekroune
2005/0115843 A1 6/2005 Harrelson
2005/0126947 A1 6/2005 Holley, Jr.
2005/0167291 A1 8/2005 Sutherland
2005/0167478 A1 8/2005 Holley, Jr.
2005/0189405 A1 9/2005 Gomes et al.
2005/0263574 A1 12/2005 Schuster
2006/0054522 A1 3/2006 Kline et al.
2006/0081691 A1 4/2006 Smalley
2006/0091193 A1 5/2006 DeBusk
2006/0118606 A1 6/2006 Holley, Jr. et al.
2006/0131370 A1 6/2006 Bates
2006/0175386 A1 8/2006 Holley, Jr.
2006/0231441 A1 10/2006 Gomes et al.
2006/0231600 A1 * 10/2006 Holley ..... 229/103.2
2006/0249413 A1 11/2006 Auclair et al.
2006/0278689 A1 12/2006 Boshinski et al.
2007/0007325 A1 1/2007 Suzuki et al.
2007/0029371 A1 2/2007 Theelen
2007/0108261 A1 5/2007 Schuster
2007/0131748 A1 6/2007 Brand
2007/0164093 A1 7/2007 Spivey et al.
2007/0181658 A1 8/2007 Sutherland
2007/0205255 A1 * 9/2007 Dunn ..... 229/117.13
2007/0210144 A1 9/2007 Brand
2007/0251982 A1 11/2007 Brand
2007/0295790 A1 12/2007 Zammit et al.
2008/0023535 A1 1/2008 Holley, Jr.
2008/0048014 A1 2/2008 Bates
2008/0128479 A1 6/2008 Bates
2009/0282843 A1 11/2009 Brand
2010/0044420 A1 2/2010 Brand et al.

| | | | |
|---|---|---|---|
| 2010/0122999 | A1 | 5/2010 | Brand |
| 2010/0237138 | A1 | 9/2010 | Bradford |
| 2011/0011924 | A1 | 1/2011 | Spivey et al. |
| 2011/0049228 | A1 | 3/2011 | Brand |
| 2011/0290692 | A1 | 12/2011 | Spivey, Sr. |

FOREIGN PATENT DOCUMENTS

| | | | |
|---|---|---|---|
| EP | 1 433 714 | A2 | 6/2004 |
| EP | 1 698 565 | A2 | 9/2006 |
| FR | 2 549 010 | | 1/1985 |
| GB | 2 264 101 | A | 8/1993 |
| JP | 2002-128064 | A | 5/2002 |
| JP | 2006-111342 | A | 4/2006 |
| JP | 2007-055630 | A | 3/2007 |
| JP | 2007 0532421 | A | 11/2007 |
| JP | 2010-149927 | A | 7/2010 |
| KR | 10-0154124 | B1 | 2/1999 |
| KR | 10-0371048 | B1 | 8/2003 |
| WO | WO 96/21603 | | 7/1996 |
| WO | WO 96/29260 | | 9/1996 |
| WO | WO 99/28198 | | 6/1999 |
| WO | WO 99/64301 | | 12/1999 |
| WO | WO 00/03937 | | 1/2000 |
| WO | WO 02/47990 | A2 | 6/2002 |
| WO | WO 2004/043790 | A2 | 5/2004 |
| WO | WO 2005/051781 | | 6/2005 |
| WO | WO 2005/100175 | A1 | 10/2005 |
| WO | WO 2006/050210 | A2 | 5/2006 |
| WO | WO 2006/050316 | A1 | 5/2006 |
| WO | WO 2007/076544 | A1 | 7/2007 |

OTHER PUBLICATIONS

Written Opinion of the International Searching Authority for PCT/US2010/027597, mailed Oct. 27, 2010.

International Search Report and Written Opinion from PCT/US2010/047102, dated May 30, 2011.

International Search Report and Written Opinion from PCT/US2010/041971 dated Mar. 1, 2011.

International Search Report and Written Opinion from PCT/US2011/037872 dated Oct. 25, 2011.

International Search Report and Written Opinion for PCT/US2011/051905 dated Apr. 23, 2012.

International Search Report and Written Opinion for PCT/US2012/026050 dated Sep. 21, 2012.

International Search Report and Written Opinion from PCT/US2011/055233 dated May 17, 2012.

Supplementary European Search Report from EP 10 75 4034 dated May 30, 2012.

* cited by examiner

CARTON WITH REINFORCED TOP PANEL

CROSS-REFERENCE TO RELATED APPLICATION

This application claims the benefit of U.S. Provisional Patent Application No. 61/210,292, filed Mar. 17, 2009.

INCORPORATION BY REFERENCE

U.S. Provisional Patent Application No. 61/210,292, which was filed on Mar. 17, 2009, is hereby incorporated by reference for all purposes as if presented herein in its entirety.

BACKGROUND OF THE DISCLOSURE

The present disclosure generally relates to cartons for holding and dispensing beverage containers or other types of articles. More specifically, the present disclosure relates to cartons having a reinforced top panel.

SUMMARY OF THE DISCLOSURE

In general, one aspect of the disclosure is generally directed to a carton containing a plurality of containers. The carton comprises a plurality of panels extending at least partially around an interior of the carton, the plurality of panels comprising a bottom panel, a first side panel foldably connected to the bottom panel, a top panel foldably connected to the first side panel, a second side panel foldably connected to the bottom panel, and a reinforcement panel foldably connected to the second side panel. The reinforcement panel being in face-to-face contact with the top panel.

In another aspect, the disclosure is generally directed to a carton for containing a plurality of articles. The carton comprises a plurality of panels extending at least partially around an interior of the carton. The plurality of panels comprises a bottom panel, a first side panel foldably connected to the bottom panel, a top panel foldably connected to the first side panel, a second side panel foldably connected to the bottom panel, and a reinforcement panel foldably connected to the second side panel. At least two end flaps are respectively foldably attached to respective panels of the plurality of panels. Wherein the end flaps are overlapped with respect to one another and thereby at least partially form a closed end of the carton. The at least two end flaps comprise a top end flap foldably connected to the first top panel and a reinforcement end flap foldably connected to the reinforcement panel. The reinforcement panel is in face-to-face contact with the top panel and the reinforcement end flap is in face-to-face contact with the top end flap.

In another aspect, the disclosure is generally directed to a blank for forming a carton. The blank comprises a plurality of panels comprising a bottom panel, a first side panel foldably connected to the bottom panel, a top panel foldably connected to the first side panel, a second side panel foldably connected to the bottom panel, and a reinforcement panel foldably connected to the second side panel. At least two end flaps are respectively foldably attached to respective panels of the plurality of panels. The at least two end flaps are for being overlapped with respect to one another to at least partially form a closed end of the carton formed from the blank. The at least two end flaps comprise a top end flap foldably connected to the first top panel and a reinforcement end flap foldably connected to the reinforcement panel. The reinforcement panel is for being positioned in face-to-face contact with the top panel in the carton formed from the blank, and the reinforcement end flap is for being in face-to-face contact with the top end flap in the carton erected from the blank.

In another aspect, the disclosure is generally directed to a method of assembling a carton. The method comprises obtaining a blank comprising a plurality of panels comprising a bottom panel, a first side panel foldably connected to the bottom panel, a top panel foldably connected to the first side panel, a second side panel foldably connected to the bottom panel, and a reinforcement panel foldably connected to the second side panel. The blank further comprises a top end flap foldably connected to the first top panel, and a reinforcement end flap foldably connected to the reinforcement panel. The method comprises forming the blank into an open-ended sleeve by positioning the reinforcement panel in face-to-face contact with the top panel, and positioning the reinforcement end flap in face-to-face contact with the top end flap.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to opening, dispensing, and handling features for cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
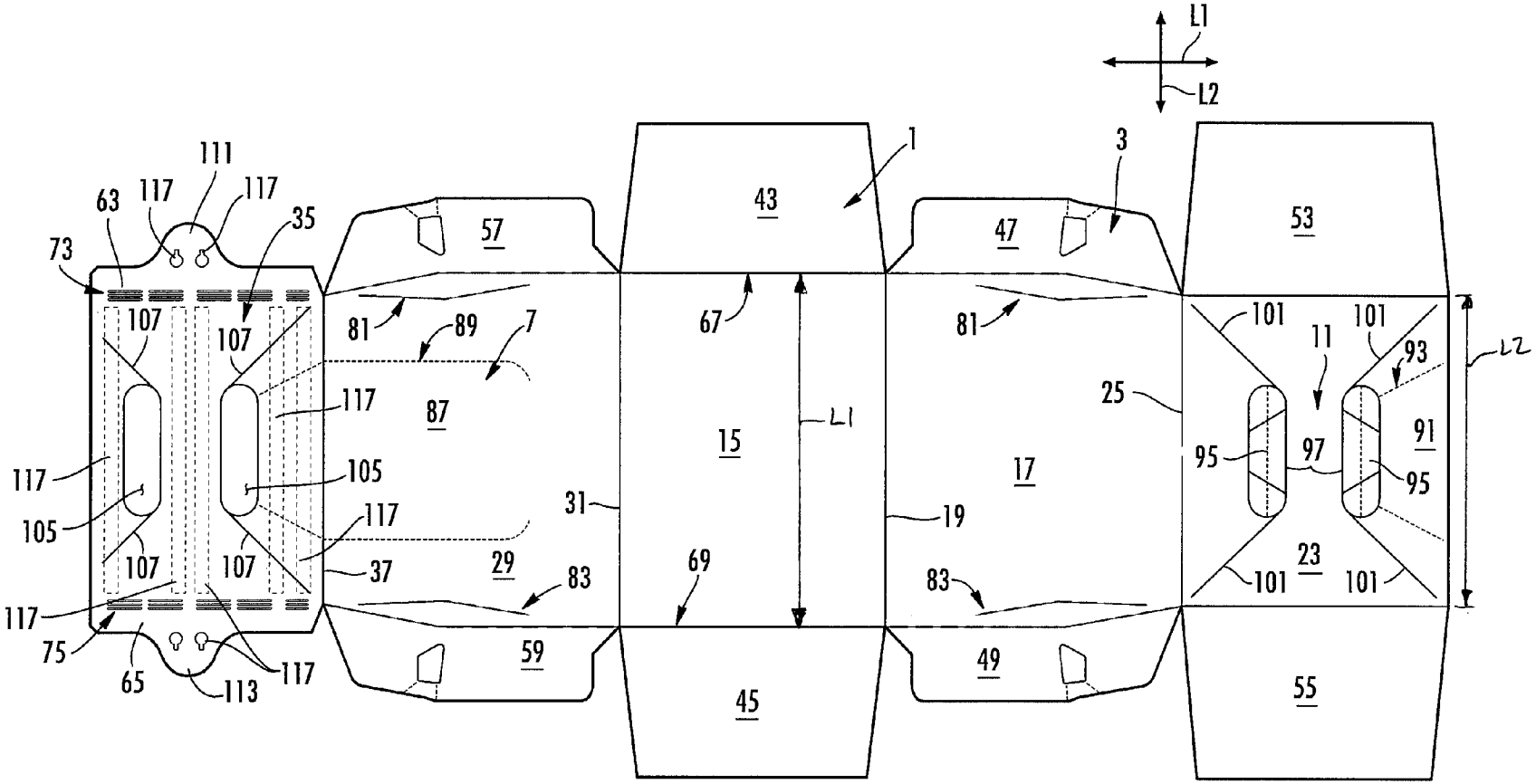
FIG. 1 is a plan view of an exterior surface of a blank of one embodiment of the disclosure.

FIG. 1 is a plan view of the exterior side 1 of a blank, generally indicated at 3, used to form a carton 5 (FIG. 2) according to the exemplary embodiment of the disclosure. The carton 5 can be used to house a plurality of articles such as containers B (FIG. 3). The carton 5 has a dispenser, generally indicated at 7 (FIG. 2), formed in the carton for allowing access to the containers B. In the illustrated embodiment, the containers B are bottles having a wide bottom portion BP (FIG. 5), a neck N extending upward from the bottom portion, a cap CP at the top of each container. In the illustrated embodiment, the carton 5 is sized to house twelve containers B in a single layer in a 3×4 arrangement, but it is understood that the carton 5 may be sized and shaped to hold containers of a different or same quantity in more than one layer and/or in different row/column arrangements (e.g., 1×6, 3×6, 2×6, 2×6×2, 3×4×2, 2×9, 3×4, etc.). The containers B could be otherwise shaped, arranged, and/or configured without departing from the disclosure. For example, the containers B could be beverage cans or other containers. In the illustrated embodiment, the carton 5 includes a handle, generally indicated at 11 (FIG. 4), for grasping and carrying the carton.

The blank 3 has a longitudinal axis L1 and a lateral axis L2. In the illustrated embodiment, the blank 3 comprises a bottom panel 15 foldably connected to a first side panel 17 at a first lateral fold line 19, a top panel 23 foldably connected to the first side panel 17 at a second lateral fold line 25, and a second side panel 29 foldably connected to the bottom panel 15 at a third lateral fold line 31. A reinforcement panel 35 is foldably connected to the second side panel 29 at a fourth lateral fold line 37.

The bottom panel 15 is foldably connected to a first bottom end flap 43 and a second bottom end flap 45. The first side panel 17 is foldably connected to a first side end flap 47 and a second side end flap 49. The top panel 23 is foldably connected to a first top end flap 53 and a second top end flap 55. The second side panel 29 is foldably connected to a first side end flap 57 and a second side end flap 59. The reinforcement panel 35 is foldably connected to a first reinforcement end flap 63 and a second reinforcement end flap 65. When the carton 5 is erected, the end flaps 43, 47, 53, 57, 63 close a first end 72 of the carton, and the end flaps 45, 49, 55, 59, 62 close a second end 74 of the carton. In accordance with an alternative embodiment of the present disclosure, different flap arrangements can be used for closing the ends of the carton 5.

The end flaps 43, 47, 53, 57 extend along a first marginal area of the blank 1, and are foldably connected at a first longitudinal fold line 67 that extends along the length of the blank. The end flaps 45, 49, 55, 59 extend along a second marginal area of the blank 1, and are foldably connected at a second longitudinal fold line 69 that also extends along the length of the blank. The longitudinal fold lines 67, 69 may be, for example, substantially straight, or offset at one or more locations to account for blank thickness or for other factors. In the illustrated embodiment, the reinforcement end flaps 63, 65 are foldably connected to the reinforcement panel 35 at respective longitudinal fold lines 73, 75. In the illustrated embodiment, the fold lines 73, 75 comprise a plurality of spaced-apart longitudinal cut lines that create five distinct and spaced-apart areas of weakening that are wider than the longitudinal fold lines 67, 69 that are single crease lines. Alternatively, the fold lines 73, 75 could be a single crease line or other form of weakening without departing from the disclosure.

In the illustrated embodiment, the blank 3 includes two diamond-shaped corners, generally indicated at 81, at the first end of the carton 5 and two diamond-shaped corners 83 at the second end of the carton. The corners 81, 83 allow respective side panels 17, 29 and side end panels 47, 57, 49, 59 to angle inward toward the interior of the carton 5. The dispenser 7 includes a first dispenser panel 87 (FIG. 1) removably attached to the blank 3 at a first tear line, generally indicated at 89, and a second dispenser panel 91 removably attached to the blank at a second tear line, generally indicated at 93. The dispenser 7 could be otherwise shaped, arranged, configured, or omitted without departing from the disclosure.

As shown in FIG. 1, the blank includes handle features for forming the handle 11 of the carton 5. The handle features include two handle flaps 95 foldably connected to the top panel 23 at lateral fold lines 97. The top panel includes oblique fold lines 101 that allow the top panel to flex when the carton 5 is grasped and carried by the handle 11. The handle 11 could be otherwise shaped, arranged, configured, or omitted without departing from the disclosure.

In the illustrated embodiment, the reinforcement panel 35 includes two elongate openings 105 and oblique fold lines 107 extending from the openings. The openings 105 are part of the handle features for forming the handle 11 and are positioned to receive the handle flaps 95 when the carton 5 is erected from the blank 3. The oblique fold lines 107 in the reinforcement panel 35 are positioned to be overlapped by the oblique fold lines 101 in the top panel 23 when the carton 5 is erected from the blank 3. Each of the reinforcement end flaps 63, 65 has a respective tab or extension 111, 113 that extends laterally outward from the fold line 73, 75. The reinforcement panel 35 and reinforcement end flaps 63, 65 could be otherwise shaped, arranged, and/or configured without departing from the disclosure.

In accordance with the exemplary embodiment, the blank 3 can be erected into the carton 5 by folding along fold lines 19, 25, 31, 37, and placing the top panel 23 in an overlapping relationship with the reinforcement panel 35. The reinforcement panel 35 can have glue or other adhesive 117 applied to its exterior surface for adhesively securing the top panel 23 and the reinforcement panel when the top panel and reinforcement panel are placed into face-to-face contact. Alternatively, glue can be placed on the top panel 23, and/or the reinforcement panel 35, or the top panel can be secured by other attachment mechanisms. When the top panel 23 overlaps the reinforcement panel 35, reinforcement flaps 63, 65 are placed into face-to-face contact with a respective top end flap 53, 55. The reinforcement flaps 63, 65 and the top end flaps 53, 55 can be adhesively secured by the adhesive 117 or they can be secured by other attachment mechanisms.

Figure 2:
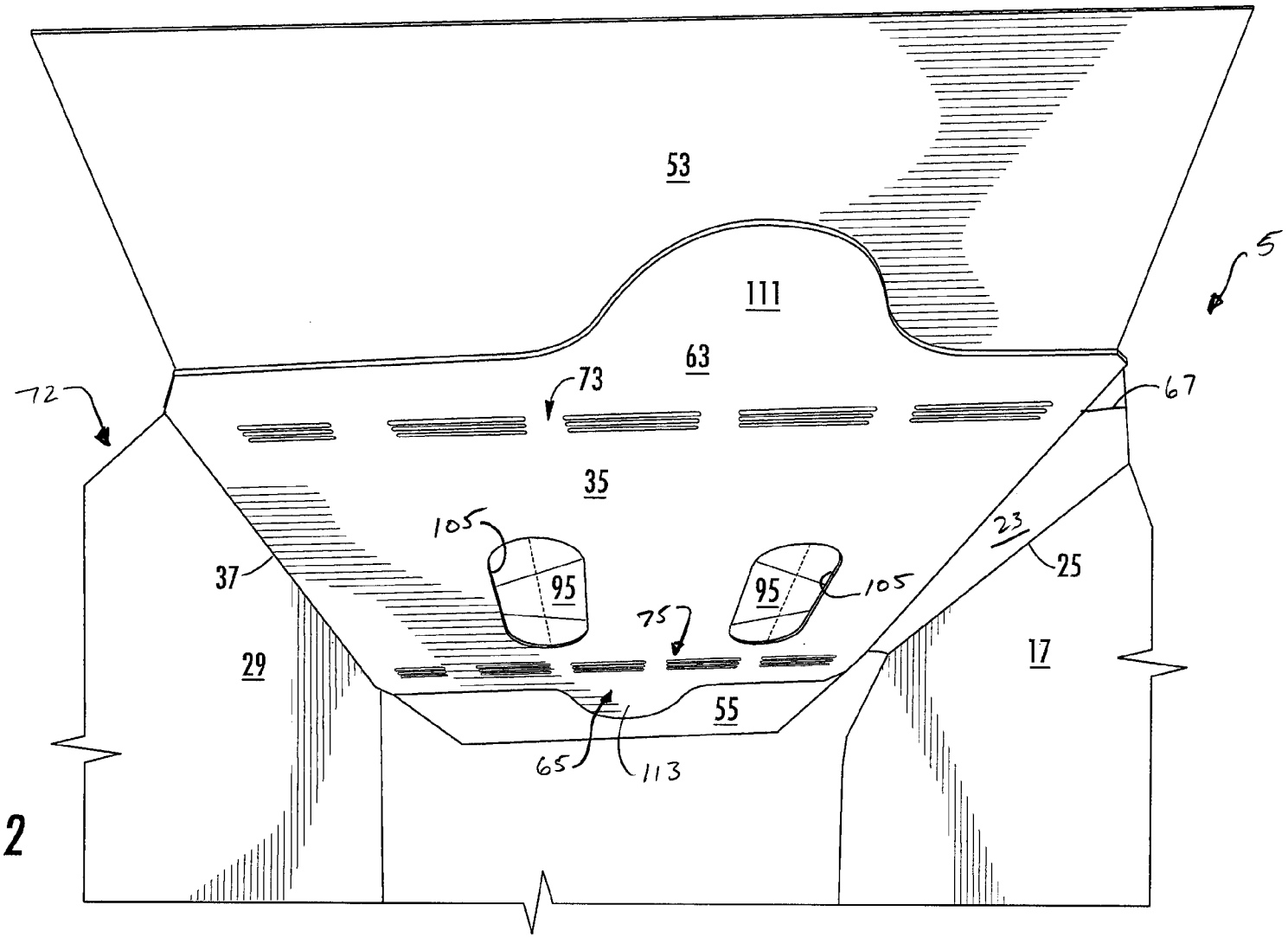
FIG. 2 is an enlarged end view of the blank partially formed into a carton.
Figure 3:
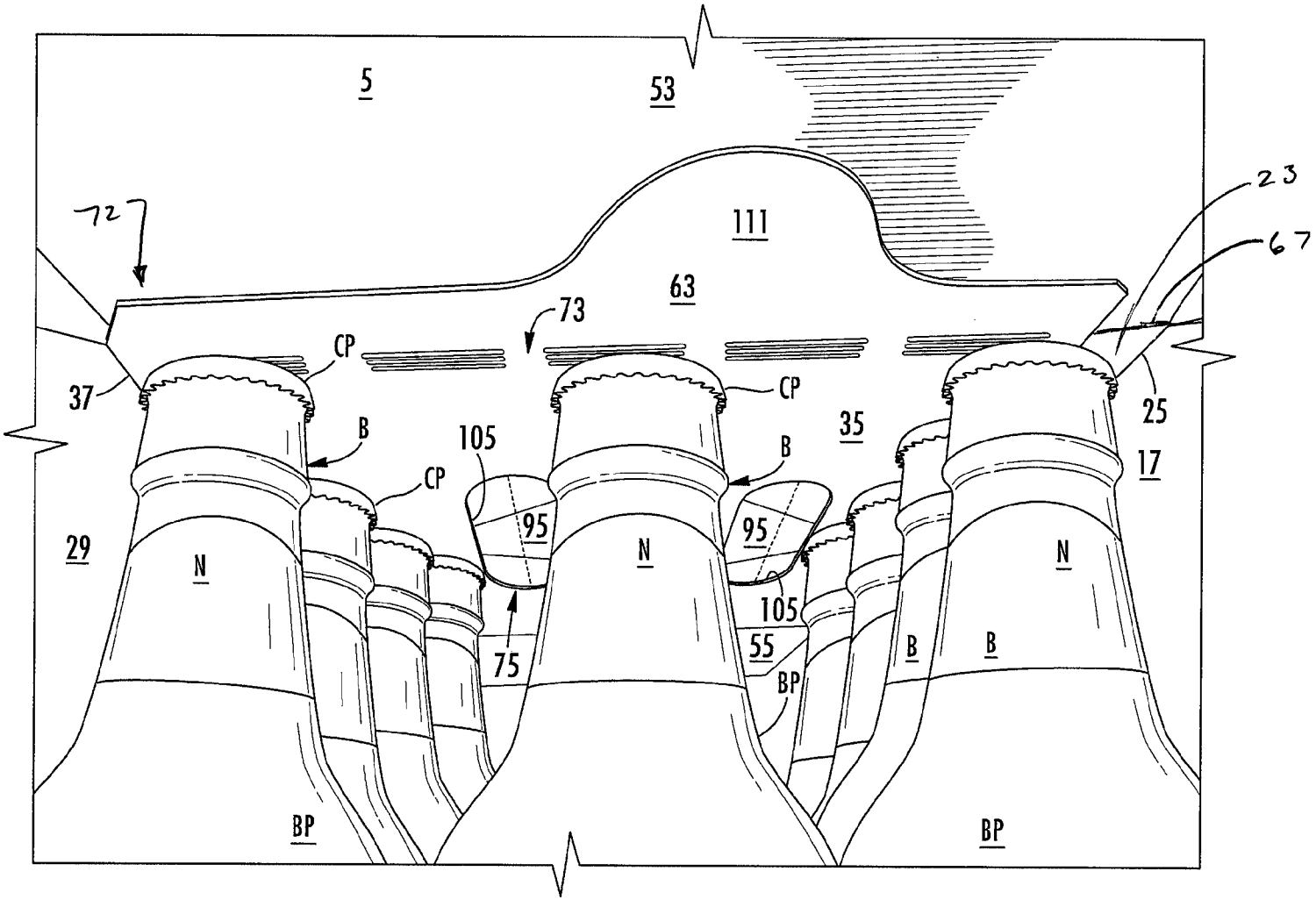
FIG. 3 is a view similar to FIG. 2 but with articles loaded into the partially formed carton.
Figure 4:
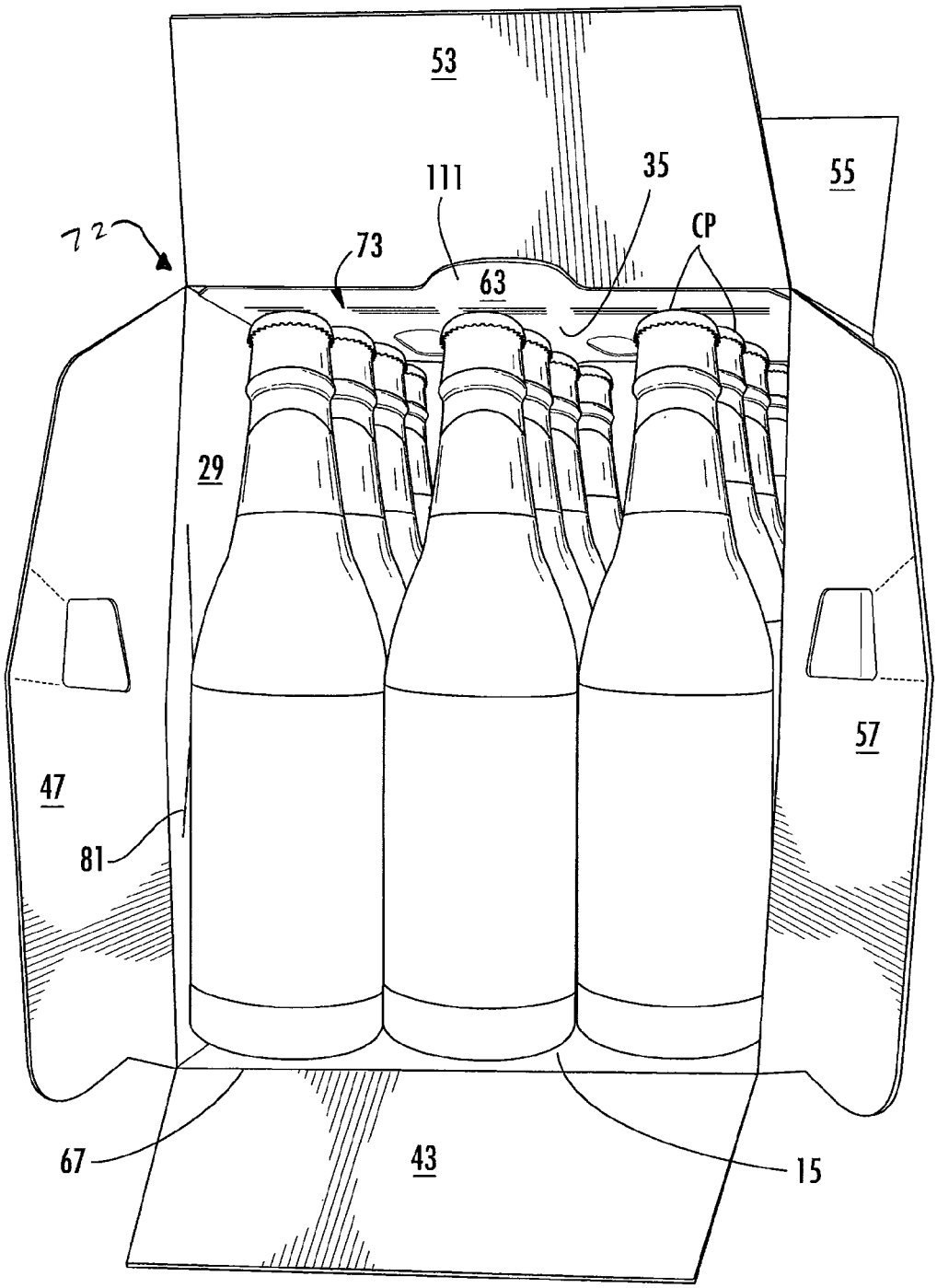
FIG. 4 is a view of a first end of the open carton loaded with articles.
Figure 5:
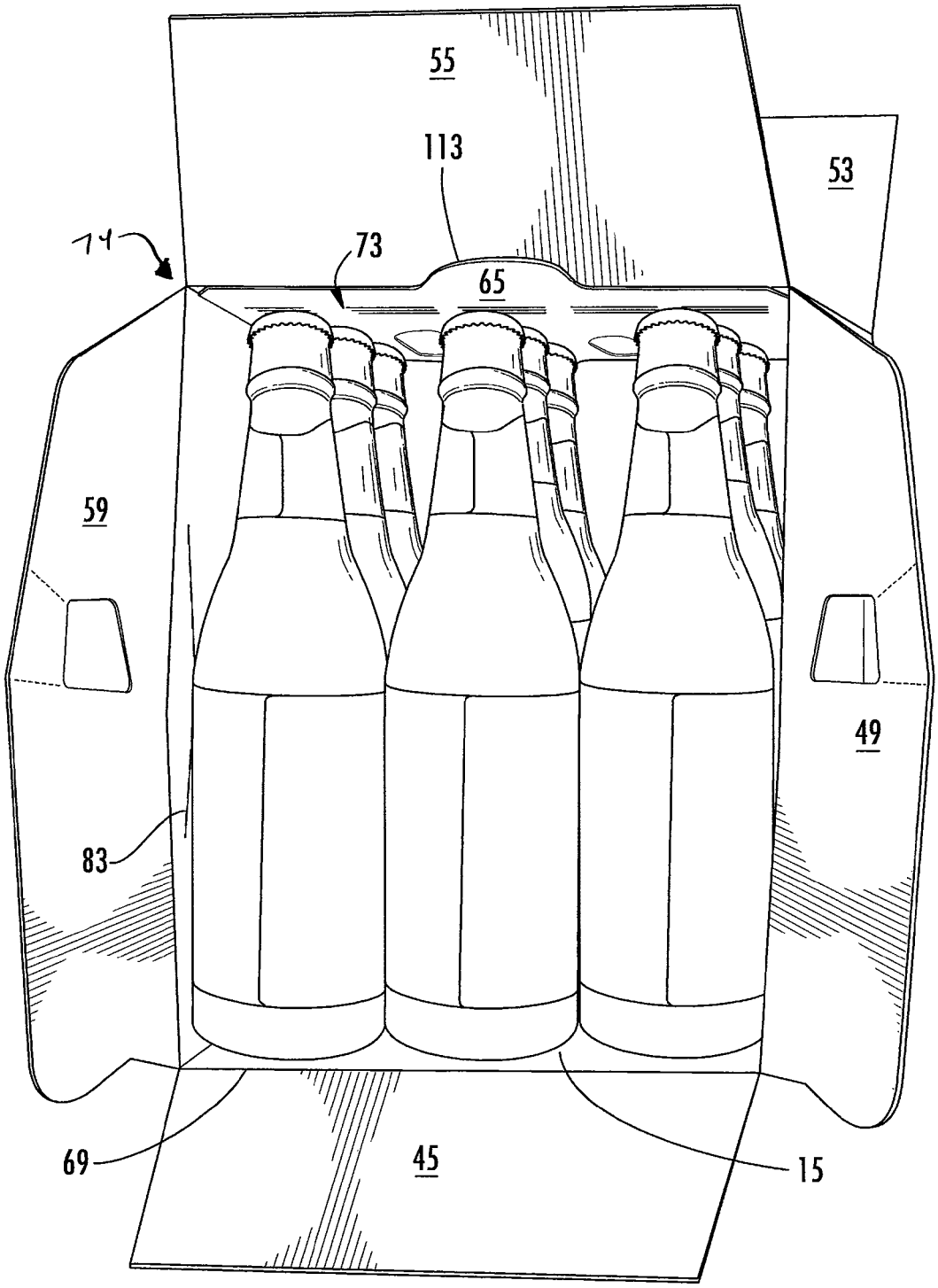
FIG. 5 us a view of a second end of the open carton loaded with articles.
Figure 6:
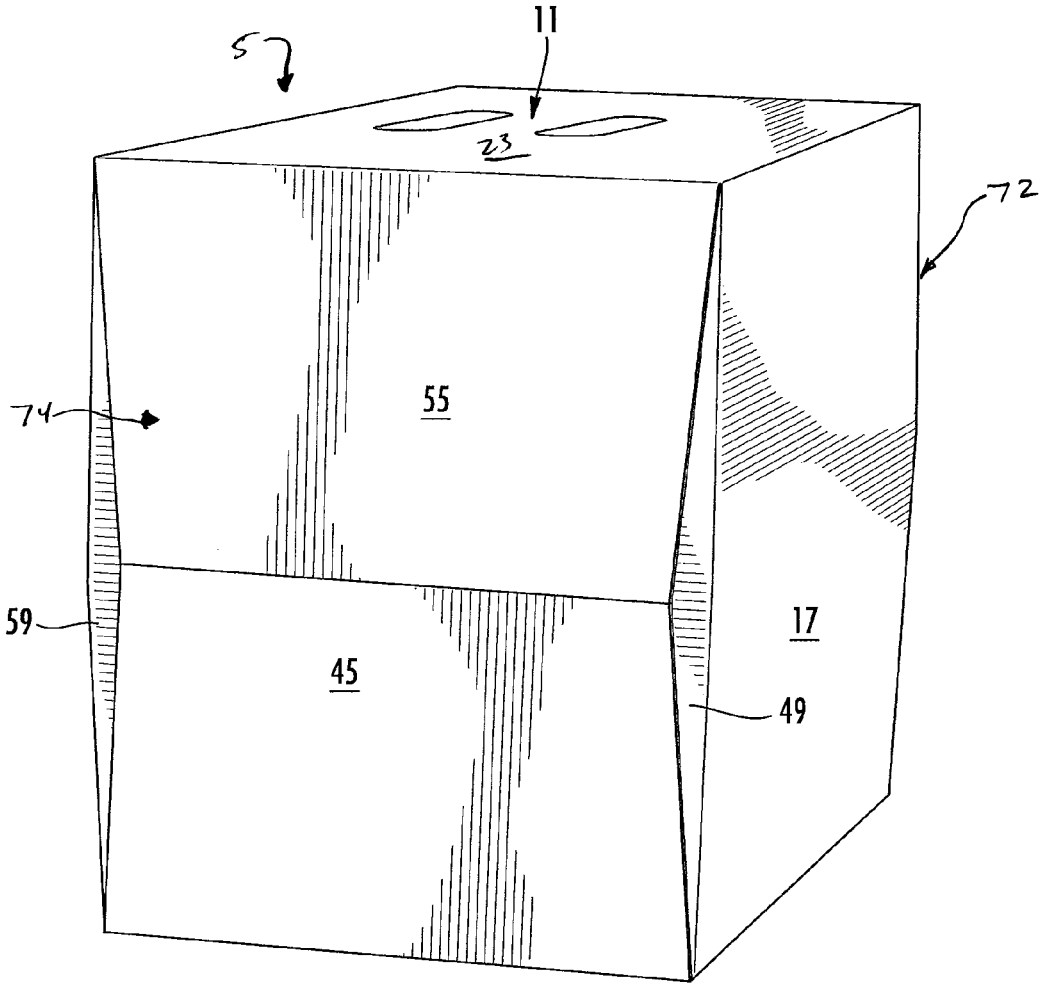
FIG. 6 is a perspective of the carton with closed ends.

As shown in the partially assembled configuration of FIGS. 2-4, the reinforcement panel 35 is in face-to-face contact with the top panel 23 and the reinforcement flaps 63, 65 are in face-to-face contact with a respective top end flap 53, 55. In the partially assembled configuration of FIG. 2, the carton 5 is an open-ended sleeve with the ends of the carton open and the containers B not yet loaded into the carton. The containers B are loaded into the carton 5 with the bottom portions BP of the containers being supported by the bottom panel 15 and the caps CP of the containers C being in contact with reinforcement panel 35. The reinforcement panel 35 and the top panel 23 provide a reinforced, two-ply top wall of the carton 5 that prevents the caps CP from penetrating, or otherwise damaging the top wall of the carton.

In the illustrated embodiment, the first end of the carton 5 is closed by respectively overlapping and adhering the end flaps 43, 47, 53, 57, 63 after the containers C are inserted into the carton. The second end of the carton 5 is closed by respectively overlapping the end flaps 45, 49, 55, 59, 65. Also, other closing and loading sequences may be used without departing from the disclosure.

The carton 5 of the present disclosure is shaped to hold bottles B in an upright position such that the bottom portions BP of the bottles are supported by the bottom panel 15 and the caps CP at the top portions of the bottles are in contact with or adjacent to the overlapped top panel 23 and reinforcement panel 35. In the illustrated embodiment, the bottom panel 15 has a length L1 greater than a length L2 of the top panel 23 so that the closed ends 72, 74 of the cartons are inwardly tapered such that the bottom of each end flap 57, 47 at one end 72 and the bottom portion of each end flap 59, 49 at the other end 74 side contacts, or is closely adjacent, the bottom portions BP of a respective container B, and the downwardly folded end flap 63 at the first end 72 and the downwardly folded end flap 65 at the second end 74 contacts, or is closely adjacent, the cap CP of a respective container. The diamond-shaped corners 81, 83 of the carton 5 allow the top portion of end flap 47, 57, 49, 59 to be angled inward so that the carton 5 is more narrow at the top than at the bottom at each end 72, 74. This narrowing of the length of the carton 5 from the bottom to the top provides two points of contact of the end flaps 63, 65 with the bottles B to hold both the top portion and the bottom portion BP of the bottles in a relatively fixed position to restrict movement of the bottles in the carton. The carton 5 of the illustrated embodiment is a two-sided taper carton, that is the length of the carton at both ends 72, 74 is longer at the bottom than at the top.

As shown in FIG. 1, the length L1 of the bottom panel 15 is less than the length L2 of the top panel 23 so that respective lateral ends of the bottom panel (corresponding to the location of the fold lines 67, 69 connecting respective bottom end flap 43, 45 to the bottom panel) extend outward from the center of the blank a greater distance than respective lateral ends of the top panel (corresponding to the location of the fold lines 67, 69 connecting respective top end flaps 53, 55 to the top panel 23).

Alternatively, the carton 5 of the present disclosure could be a four-sided taper carton where the length at both ends is longer at the bottom than at the top at both ends 72, 74, and the width of the bottom panel 15 is greater than the width of the top panel 23 so that the width at both side panels 17, 29 is longer at the bottom of the carton than at the top. A four sided taper carton would have ends 72, 74 that angle inwardly from the bottom to the top and side panels 17, 29 that angle inwardly from the bottom to the top. Also, the carton 5 could be a three-sided taper carton, with only one end 72, 74 or one side panel 17, 29 that angle inwardly from the bottom to the top. Further, the carton could alternatively be without any sides or ends that taper and all four of the ends 72, 74 and side panels 17, 29 could be substantially perpendicular without departing from the scope of the disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blanks. The blank can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these, features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels extending at least partially around an interior of the carton, the plurality of panels comprises a bottom panel, a first side panel foldably connected to the bottom panel, a top panel foldably connected to the first side panel, a second side panel foldably connected to the bottom panel, and a reinforcement panel foldably connected to the second side panel;

at least two end flaps respectively foldably attached to respective panels of the plurality of panels, wherein the end flaps are overlapped with respect to one another and thereby at least partially form a closed end of the carton, the at least two end flaps comprise a top end flap foldably connected to the first top panel and a reinforcement end flap foldably connected to the reinforcement panel at a fold line, wherein the reinforcement end flap comprises an extension that is in face-to-face contact with the top end flap, the extension is a central portion adjacent a distal portion of the reinforcement end flap, the extension has an outermost free edge spaced farther away from the fold line than an outermost free edge of the distal portion; and the reinforcement panel being in face-to-face contact with the top panel and the reinforcement end flap being in face-to-face contact with the top end flap.

2. The carton of claim 1 wherein the reinforcement panel is adhesively secured to the top panel and the extension is adhesively secured to the top end flap.

3. The carton of claim 1 wherein a first line of weakening comprises the fold line;

the reinforcement end flap is foldably connected to the reinforcement panel at the first line of weakening, the top end flap is foldably connected to the top panel at a second line of weakening, the first line of weakening and the second line of weakening being in overlapping relationship.

4. The carton of claim 3 wherein the first line of weakening comprises a plurality of spaced-apart lateral fold lines that form distinct and spaced-apart areas of weakening, and the second line of weakening comprises a fold line.

5. The carton of claim 4 wherein the plurality of spaced-apart areas of weakening are wider than the fold line of the second line of weakening.

6. The carton of claim 1 further comprising a handle, the handle comprising a first handle panel foldably connected to the top panel, a second handle panel foldably connected to the top panel, a first handle opening in the reinforcement panel, and a second handle opening in the reinforcement panel, the first handle panel and the first handle opening being generally aligned and the second handle panel and the second handle opening being generally aligned.

7. The carton of claim 1 wherein:

the closed end is a first closed end;

the end flaps are first end flaps that are overlapped with respect to one another to form the first closed end;

the carton comprises at least two second end flaps respectively foldably connected to respective panels of the plurality of panels, wherein the second end flaps are overlapped with respect to one another to form a second closed end of the carton, the at least two second end flaps comprise a second top end flap foldably connected to the top panel and a second reinforcement end flap foldably connected to the reinforcement panel.

8. The carton of claim 7 wherein the bottom panel has a first length and the top panel has a second length, the first length being greater than the second length so that the carton angles inwardly from the bottom to the top at the first closed end and the carton angles inwardly from the bottom to the top at the second closed end.

9. The carton of claim 8 wherein at the first closed end the bottom panel extends outward from the center of the carton a greater distance than the top panel and at the second closed end the bottom panel extends outward from the center of the carton a greater distance than the top panel.

10. The carton of claim 1, wherein the fold line extending across the width of the reinforcement end flap and is free of openings along the fold line.

11. A blank for forming a carton comprising:

a plurality of panels comprising a bottom panel, a first side panel foldably connected to the bottom panel, a top panel foldably connected to the first side panel, a second side panel foldably connected to the bottom panel, and a reinforcement panel foldably connected to the second side panel; and at least two end flaps respectively foldably attached to respective panels of the plurality of panels, the at least two end flaps are for being overlapped with respect to one another to at least partially form a closed end of the carton formed from the blank, the at least two end flaps comprise a top end flap foldably connected to the first top panel and a reinforcement end flap foldably connected to the reinforcement panel at a fold line, wherein the reinforcement end flap comprises an extension that is for being in face-to-face contact with the top end flap in the carton erected from the blank, the extension is a central portion adjacent a distal portion of the reinforcement end flap, the extension has an outermost free edge spaced farther away from the fold line than an outermost free edge of the distal portion, the reinforcement panel is for being positioned in face-to-face contact with the top panel in the carton formed from the blank and the reinforcement end flap is for being in face-to-face contact with the top end flap in the carton erected from the blank.

12. The blank of claim 11 wherein a first line of weakening comprises the fold line;

the reinforcement flap is foldably connected to the reinforcement panel at the first line of weakening, the top end flap is foldably connected to the top panel at a second line of weakening, the first line of weakening and the second line of weakening being in overlapping relationship in the carton erected from the blank.

13. The blank of claim 12 wherein the first line of weakening comprises a plurality of spaced-apart lateral fold lines that form distinct and spaced-apart areas of weakening, and the second line of weakening comprises a fold line.

14. The blank of claim 13 wherein the spaced-apart areas of weakening are wider than the fold line of the second line of weakening.

15. The blank of claim 11 further comprising handle features for forming a handle in the carton formed from the blank, the handle features comprising a first handle panel foldably connected to the top panel, a second handle panel foldably connected to the top panel, a first handle opening in the reinforcement panel, and a second handle opening in the reinforcement panel, the first handle panel and the first handle opening are for being generally aligned in the carton formed from the blank and the second handle panel and the second handle opening are for being generally aligned in the carton formed from the blank.

16. The blank of claim 11 wherein:

the closed end is a first closed end;

the end flaps are first end flaps that are overlapped with respect to one another to form the first closed end in the carton erected from the blank;

the blank comprises at least two second end flaps respectively foldably connected to respective panels of the plurality of panels, wherein the second end flaps are for being overlapped with respect to one another to form a second closed end of the carton erected from the blank, the at least two second end flaps comprise a second top end flap foldably connected to the top panel and a second reinforcement end flap foldably connected to the reinforcement panel.

17. The blank of claim 16 wherein the bottom panel has a first length and the top panel has a second length, the first length being greater than the second length so that respective lateral ends of the bottom panel extend outward from the center of the carton a greater distance than respective lateral ends of the top panel.

18. The blank of claim 11, wherein the fold line extending across the width of the reinforcement end flap and is free of openings along the fold line.

19. A method of assembling a carton comprising:

obtaining a blank comprising a plurality of panels comprising a bottom panel, a first side panel foldably connected to the bottom panel, a top panel foldably connected to the first side panel, a second side panel foldably connected to the bottom panel, and a reinforcement panel foldably connected to the second side panel, a top end flap foldably connected to the first top panel, and a reinforcement end flap foldably connected to the reinforcement panel at a fold line, wherein the reinforcement end flap comprises an extension that is in face-to-face contact with the top end flap, the extension is a central portion adjacent a distal portion of the reinforcement end flap, the extension has an outermost free edge spaced farther away from the fold line than an outermost free edge of the distal portion;

forming the blank into an open-ended sleeve by positioning the reinforcement panel in face-to-face contact with the top panel, and positioning the reinforcement end flap in face-to-face contact with the top end flap.

20. The method of claim 19 further comprises adhesively securing the reinforcement panel to the top panel and adhesively securing the reinforcement end flap to the top end flap.

21. The method of claim 19 wherein a first line of weakening comprises the fold line;

the reinforcement flap is foldably connected to the reinforcement panel at the first line of weakening, the top end flap is foldably connected to the top panel at a second line of weakening, the method further comprises placing the first line of weakening and the second line of weakening in overlapping relationship.

22. The method of claim 19 wherein the blank further comprises handle features comprising a first handle panel foldably connected to the top panel, a second handle panel foldably connected to the top panel, a first handle opening in the reinforcement panel, and second handle opening in the reinforcement panel, the forming the blank into an open-ended sleeve comprises substantially aligning the first handle panel and the first handle opening and substantially aligning the second handle panel and the second handle opening.

23. The method of claim 19 wherein the blank further comprises a bottom end flap foldably connected to the bottom panel, a first side end flap foldably connected to the first side panel, and a second side end flap foldably connected to the second side panel, the method further comprising inserting a plurality of articles into the open-ended sleeve and at least partially overlapping the bottom end flap, the first side end flap, the second side end flap, the top end flap, and the reinforcement end flap to close an end of the open-ended sleeve.

24. The method of claim 23 wherein the bottom panel has a first length and the top panel has a second length, the first length being greater than the second length so that the carton angles inwardly from the bottom to the top at the closed end of the open-ended sleeve.

25. The method of claim 24 wherein the end is a first end of the open-ended sleeve, the bottom end flap is a first bottom end flap, the top end flap is a first top end flap, and the reinforcement end flap is a first reinforcement end flap, the blank further comprises a third side end flap foldably connected to the first side panel, a fourth side end flap foldably connected to the second side panel, a second top end flap foldably connected to the top panel, a second reinforcement end flap foldably connected to the second reinforcement panel, and a second bottom end flap foldably connected to the bottom panel, the method further comprises at least partially overlapping the third side end flap, the fourth side end flap, the second top end flap, the second bottom end flap, and the second reinforcement end flap to at least partially close a second end of the open-ended sleeve.

26. The method of claim 25 wherein the carton angles inwardly from the bottom to the top at the second closed end of the open-ended sleeve.

27. The method of claim 19, wherein the fold line extending across the width of the reinforcement end flap and is free of openings along the fold line.

* * * * *